US009269467B2

(12) United States Patent
Stevenson

(10) Patent No.: US 9,269,467 B2
(45) Date of Patent: Feb. 23, 2016

(54) GENERAL RADIOISOTOPE PRODUCTION METHOD EMPLOYING PET-STYLE TARGET SYSTEMS

(76) Inventor: Nigel Raymond Stevenson, Sugar Hill, GA (US)

( * ) Notice: Subject to any disclaimer, the term of this patent is extended or adjusted under 35 U.S.C. 154(b) by 662 days.

(21) Appl. No.: 13/485,885

(22) Filed: May 31, 2012

(65) Prior Publication Data

US 2012/0307953 A1 Dec. 6, 2012

Related U.S. Application Data

(60) Provisional application No. 61/492,611, filed on Jun. 2, 2011.

(51) Int. Cl.
*G21G 1/10* (2006.01)
*G21G 1/00* (2006.01)

(52) U.S. Cl.
CPC ..... *G21G 1/10* (2013.01); *G21G 2001/0015* (2013.01); *G21G 2001/0021* (2013.01); *G21G 2001/0042* (2013.01); *G21G 2001/0052* (2013.01); *G21G 2001/0057* (2013.01); *G21G 2001/0063* (2013.01); *G21G 2001/0073* (2013.01); *G21G 2001/0094* (2013.01)

(58) Field of Classification Search
CPC . G21G 1/00; G21G 1/001; G21G 2001/0094; G21G 1/04; G21G 1/10
See application file for complete search history.

(56) References Cited

U.S. PATENT DOCUMENTS

| | | | |
|---|---|---|---|
| 3,971,697 | A | 7/1976 | Blue |
| 5,296,203 | A | 3/1994 | Phillips et al. |
| 5,417,391 | A | 5/1995 | Savitsky et al. |
| 5,422,345 | A | 6/1995 | Dougan |
| 5,425,063 | A | 6/1995 | Ferrieri et al. |
| 5,440,211 | A | 8/1995 | Jongen |
| 5,784,423 | A | 7/1998 | Lidsky et al. |
| 5,917,874 | A | 6/1999 | Schlyer et al. |
| 6,433,336 | B1 | 8/2002 | Jongen et al. |
| 6,567,492 | B2 | 5/2003 | Kiselev et al. |
| 6,617,574 | B2 | 9/2003 | Kelson et al. |
| 6,651,349 | B2 | 11/2003 | Coplon et al. |
| 6,683,426 | B1 | 1/2004 | Kleeven |

(Continued)

OTHER PUBLICATIONS

European Patent Office International Search Report for PCT/US2012/040403 filed on Jun. 1, 2012, report mailed on Sep. 17, 2012; 9 pp.

(Continued)

*Primary Examiner* — Jack W Keith
*Assistant Examiner* — Marshall O'Connor
(74) *Attorney, Agent, or Firm* — Wood, Herron & Evans, LLP

(57) ABSTRACT

Methods for producing a radioisotope by a charged particle irradiation of a fluid target matrix are provided. A method of producing a radioisotope includes irradiating a fluid target matrix comprising a compound of a target isotope with a charged particle beam to transform at least a portion of the target isotope to the radioisotope, and isolating the radioisotope from the irradiated fluid target matrix. The target isotope may be an isotope of cadmium, an isotope of thallium, an isotope of zinc, an isotope of gallium, an isotope of tellurium, an isotope of molybdenum, an isotope of rhodium, an isotope of selenium, an isotope of nickel, an isotope of yttrium, an isotope of strontium, an isotope of bismuth, an isotope of tungsten, and an isotope of titanium, provided that the target isotope is not Mo-100.

21 Claims, 1 Drawing Sheet

(56) References Cited

U.S. PATENT DOCUMENTS

Figure 1:
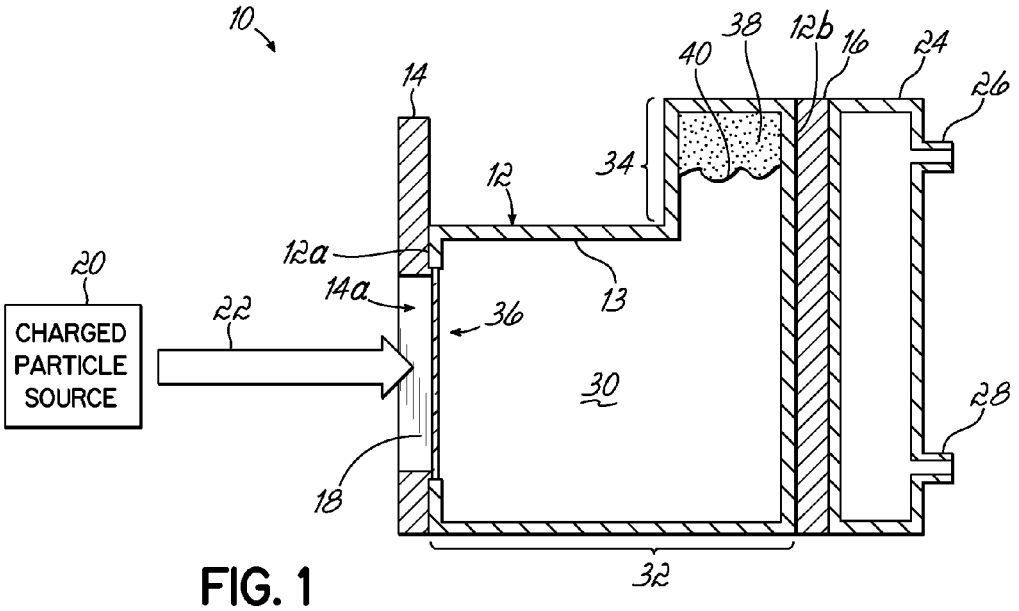

| | | | | |
|---|---|---|---|---|
| 6,717,162 | B1 | 4/2004 | Jongen | |
| 6,770,891 | B2 | 8/2004 | Rose | |
| 6,777,692 | B2 | 8/2004 | Jongen | |
| 6,780,850 | B1 | 8/2004 | Dougan et al. | |
| 6,845,137 | B2 | 1/2005 | Ruth et al. | |
| 6,873,123 | B2 | 3/2005 | Marchand et al. | |
| 7,023,000 | B2 | 4/2006 | Zyuzin | |
| 7,140,881 | B1 | 11/2006 | Gealon | |
| 7,163,419 | B2 | 1/2007 | Stanford | |
| 7,197,111 | B2 | 3/2007 | Rose et al. | |
| 7,289,600 | B2 | 10/2007 | Herer et al. | |
| 7,307,264 | B2 | 12/2007 | Brusasco et al. | |
| 7,345,291 | B2 | 3/2008 | Kats | |
| 7,446,490 | B2 | 11/2008 | Jongen et al. | |
| 7,456,591 | B2 | 11/2008 | Jongen | |
| 7,486,771 | B2 | 2/2009 | Stichelbaut et al. | |
| 7,512,206 | B2 | 3/2009 | Wieland | |
| 7,513,193 | B2 | 4/2009 | Allen et al. | |
| 7,860,216 | B2 | 12/2010 | Jongen et al. | |
| 2003/0006379 | A1 | 1/2003 | Hino et al. | |
| 2005/0069076 | A1 | 3/2005 | Bricault et al. | |
| 2006/0022127 | A1 | 2/2006 | Zyuzin | |
| 2007/0217561 | A1* | 9/2007 | Wieland et al. | 376/317 |
| 2008/0023645 | A1 | 1/2008 | Amelia et al. | |
| 2008/0241025 | A1 | 10/2008 | Lapi et al. | |
| 2009/0090875 | A1 | 4/2009 | Gelbart et al. | |
| 2010/0059688 | A1 | 3/2010 | Claereboudt et al. | |
| 2010/0166653 | A1* | 7/2010 | Stevenson et al. | 424/1.61 |
| 2010/0243875 | A1 | 9/2010 | Plompen et al. | |
| 2010/0272241 | A1 | 10/2010 | Amelia et al. | |
| 2011/0002431 | A1 | 1/2011 | Johnson et al. | |
| 2011/0280357 | A1 | 11/2011 | Stevenson | |

OTHER PUBLICATIONS

Cuninghame, J.G., et al., Large Scale Production of 123I from a Flowing Liquid Target Using the (p, 5n) Reaction, Int J. Appl. Radiat. Isot., vol. 27, 1976, pp. 597-603. (7pp).

Hutter, J.L. et al., Production of 77Br for TDPAC Studies, Appl. Radiat. Isot., vol. 43, 1992, pp. 1393-1398. (6pp.).

Galiano, E., et al., The Cyclotron Production of Carrier-free 77Br via the 79Br(p, 3n)77Kr 77Br Reaction using a Liquid Target and On-line Extraction, Appl. Radiat. Isot., vol. 49, 1996, pp. 105-111. (7pp.).

Ralis, J., et al., Liquid Target System for Production of 86Y, The 13th International Workshop on Targetry and Target Chemistry Proceedings, Riso-R-1787(EN), Jun. 2011, pp. 234-235. (3 pp.).

Jensen, M., et al., Direct Production of Ga-68 from Proton Bombardment of Concentrated Aqueous Solutions of [Zn-68] Zinc Chloride, The 13th International Workshop on Targetry and Target Chemistry Proceedings, Riso-R-1787 (EN), Jun. 2011, pp. 288-289. (3 pp.).

Technetium-99m, from Wikipedia, printed Mar. 21, 2011 (7 pages).

Targholizadeh et al, Cyclotron production of technetium radionuclides using a natural metallic molybdenum thick target and consequent preparation of [Tc]-BRIDA as a radio-labelled kit sample, Nukleonika 2010, 55(1):113-118.

Montgomery, An Accelerator-Based Temporary Solution to the Medical Isotope Shortage, Canadian Undergraduate Physics Journal, vol. VII, Issue 2, May 2010, pp. 10-11.

Takacs, et al, Evaluation of proton induced reactions on 100Mo: New cross sections for production of 99mTc and 99Mo, Journal of Radioanalytical and Nuclear Chemistry, vol. 257, No. 1, 195-201, printed Mar. 21, 2011 from www. springerlink.com/content/q416677r44765223/abstract, Abstract and preview page only (3 pages).

Pugachev et al, Design of the Target for 99Mo Production in the Electron Linear Accelerator, (2 pages).

Chemistry & Medical Isotopes, Medical Isotopes for Canada: A Role for Chemistry and TRIUMF, Canada's National Laboratory for Particle and Nuclear Physics, printed from ww.triumf.ca/chemistry/chemistry-medical-isotopes Mar. 21, 2011 (3 pages).

Dehnel, et al, A Compact Cost-Effective Beamline for a PET Cyclotron (9 pages).

Carney, Principles of PET Imaging, Multi-modal Neuroimaging Training Program (MNTP), Tuesday, Jun. 19, 2007 (21 pages).

Radionuclides & Radiopharmaceuticals, Centre for Positron Emission Tomography, Austin Hospital, Melbourne, Australia, printed from www.petnm.unimelb.edu.au/pet/detail/radionuc, Apr. 14, 2011 (4 pages).

Scholten et al, Excitation functions for the cyclotron production of 99mTc and 99Mo, Applied Radiation and Isotopes 51 (1999) 69-80.

Tang, Radionuclide production and yields at Washington University School of Medicine, QJ Nucl Med Mol Imaging 2008, 52:121-33.

Lewis, 99Mo supply—the times they are a-changing, Eur J Nucl Med Mol Imaging (2009) 36:1371-1374.

Hong et al, The Performance of Double-Grid 0-18 Water Target for FDG Production, Proceedings of EPAC 2006, Edinburgh, Scotland, WEPCH173, pp. 2337-2339.

European Patent Office International Search Report for PCT/US2011/036447 filed on May 13, 2011, report mailed on Oct. 4, 2011; 11 pp.

Lagunas-Solar M C, Acceleratori Production of 99mTc With Proton Beams and Enriched 100Mo, Targets, IAEA Technical Documents Series, Internation Atomic Energy Agency, AT, No. IAEA-TECDOC-1065, Jan. 1, 1999, pp. 87-112.

Egan G. et al., An Investigation Into the Technical Feasibility of Cyclotron Production of Technetium-99m, ANZ Nuclear Medicine, LLE, Mar. 1, 1994, pp. 25-31.

Office Action issued in U.S. Appl. No. 13/106,634, mailed Jul. 22, 2015, 30 pages.

* cited by examiner

GENERAL RADIOISOTOPE PRODUCTION METHOD EMPLOYING PET-STYLE TARGET SYSTEMS

CROSS-REFERENCE TO RELATED APPLICATIONS

This application claims the benefit of U.S. Provisional Patent Application Ser. No. 61/492,611, filed Jun. 2, 2011, which is hereby incorporated by reference herein in its entirety.

FIELD OF THE INVENTION

The invention relates to production of radioisotopes by charged particle irradiation of a fluid target matrix.

BACKGROUND

Radioisotopes used in various medical applications are most often produced either with reactors or accelerators, and solid target systems. Most often the targets come in the form of electroplated or melted/sputtered metals deposited on a water-cooled substrate. Alternatively, foils or compacted powders can be irradiated. Examples of such are electroplated Tl-203 to produce Tl-201 and melted Bi-209 to produce At-211.

Moreover, commercial radioisotope production generally involves very labor-intensive processing and therefore is best suited to centralized production of large batch quantities. The radioisotopes produced are subsequently sent to several regional radiopharmacies for further processing and distribution to hospitals and clinics. The relatively long half-life of certain radioisotopes (several hours/days) allows for this distribution system. However, because of their inherent short half-lives (typically less than 2 hrs), the positron emission tomography (PET) isotopes such as F-18, O-15, N-13, and C-11, have to be produced on a local basis close to the hospitals and clinics administering the radiopharmaceuticals.

In order to meet this need, networks of regional production centers have emerged in practically every significant urban area in North America and Europe. These PET centers typically have a small accelerator (cyclotron) and an automated chemistry system required to manufacture a final injectable product. PET targetry only employ fluid (liquid or gas) systems that allow for rapid transfer to the automated chemistry system for processing after the irradiation is complete. Accordingly, these PET cyclotrons systems are generally fitted with commercially-available F-18 production targets and automated chemistry systems to manufacture fluorinated deoxyglucose (FDG).

The F-18 production target is a cylindrical, conical or similar hollow container filled with $H_2{}^{18}O$ which is irradiated with a proton beam and forms F-18 by the nuclear reaction $^{18}O(p,n)^{18}F$. The irradiated water is transferred to the automated chemistry system, which extracts the $^{18}F$ and produces the desired end product, $^{18}FDG$, in a Good Manufacturing Practices (GMP) environment ready for clinical use. However, viable methods that can take advantage of the foregoing attributes of PET cyclotron FDG systems to prepare other radioisotopes do not currently exist.

Accordingly, new methods of generating useful radioisotopes using a PET cyclotron (or a similar accelerator) and associated targetry and chemistry systems are needed.

SUMMARY

According to embodiments of the present invention, a method of producing a radioisotope is provided. The method comprises: irradiating a fluid target matrix comprising a compound of a target isotope with a charged particle beam to transform at least a portion of the target isotope to the radioisotope and provide an irradiated fluid target matrix; and isolating the radioisotope from the irradiated fluid target matrix, wherein the target isotope is selected from the group consisting of: an isotope of cadmium, an isotope of thallium, an isotope of zinc, an isotope of gallium, an isotope of tellurium, an isotope of molybdenum, an isotope of rhodium, an isotope of selenium, an isotope of nickel, an isotope of yttrium, an isotope of strontium, an isotope of bismuth, an isotope of tungsten, and an isotope of titanium, with the proviso that the isotope of molybdenum is not Mo-100.

According to another embodiment of the present invention, a method of producing a plurality of radioisotopes is provided. The method comprises irradiating a fluid target matrix comprising a compound having a first target isotope and a second isotope, with a charged particle beam to transform at least a portion of the first target isotope and at least a portion of the second isotope to a first radioisotope and a second radioisotope, respectively, and thereby provide an irradiated fluid target matrix; and separating from the irradiated fluid target matrix at least a portion of the first radioisotope and at least a portion of the second radioisotope, wherein the first and second target isotopes are selected from the group consisting of: an isotope of cadmium, an isotope of thallium, an isotope of zinc, an isotope of gallium, an isotope of tellurium, an isotope of molybdenum, an isotope of rhodium, an isotope of selenium, an isotope of nickel, an isotope of yttrium, an isotope of strontium, an isotope of bismuth, an isotope of tungsten, and an isotope of titanium, with the proviso that the isotope of molybdenum is not Mo-100.

DETAILED DESCRIPTION OF EMBODIMENTS OF THE INVENTION

The method and processes described herein provide for the generation and isolation of one or more desired radioisotopes, at commercially-viable yields and without utilizing a high flux nuclear reactor and/or solid targets. Briefly, the process includes preparing one or more targets comprising a fluid target matrix containing one or more compounds of a target isotope. The fluid target matrix is irradiated with a charged particle beam, such as a proton beam, a deuteron beam, or an alpha particle beam, to transform at least a portion of the target isotope to the desired radioisotope. The irradiated fluid target matrix is subjected to a purification process to separate and isolate at least a portion of the desired radioisotope from the matrix of the irradiated fluid target matrix.

As used herein, the term "fluid" generally means any suitable flowable medium, such as liquid, gas, vapor, plasma, supercritical fluid, or combinations thereof, that is capable of flowing and easily changing shape.

As used herein, the term "liquid" generally means any fluid that has no independent shape but has a definite volume and does not expand indefinitely and that is only slightly compressible. A liquid is neither a solid nor a gas, but a liquid may have one or more solids and/or gases dissolved therein. Exemplary liquids include water and organic solvents.

As used herein, the terms "vapor" and "gas" may be used interchangeably and generally mean any fluid that can move and expand without restriction except for a physical boundary such as a surface or wall, and thus can include a gas phase, a gas phase in combination with a liquid phase such as a droplet (e.g., steam), supercritical fluid, or the like.

As used herein, the term "fluid target matrix" means any non-solid, flowable medium wherein the target material is contained, solvated, dispersed or the like.

As used herein, the term "target material" means a chemical substance comprising a target isotope selected from the group consisting of an isotope of cadmium, an isotope of thallium, an isotope of zinc, an isotope of gallium, an isotope of tellurium, an isotope of molybdenum, an isotope of rhodium, an isotope of selenium, an isotope of nickel, an isotope of yttrium, an isotope of strontium, an isotope of bismuth, an isotope of tungsten, and an isotope of titanium, which can be carried in a fluid target matrix and when irradiated by a suitable particle beam, such as a proton, deuteron or an alpha particle beam, the target isotope in the chemical substance is transformed to produce the desired radioisotope according to the nuclear reaction equations represented in Table 1 below. According to embodiments of the present invention, where the target isotope includes an isotope of molybdenum, the isotope is not Mo-100.

TABLE 1

Exemplary target isotopes and corresponding radioisotopes.

| Product Isotope | Target Isotope | Reaction | Target Material/Carrier |
|---|---|---|---|
| In-111 | Cd-112 | (p, 2n) | Cl, Br, Ac, CN, F, $NO_3$, $SO_4$, |
| | Cd-111 | (p, n) | $SeO_4$ |
| | Cd-110 | (d, n) | |
| Pb-201 | Tl-203 | (p, 3n) | $NO_3$, Cl, F, O, $SeO_4$, $SO_4$ |
| Ga-67 | Zn-68 | (p, 2n) | Ac, Br, Cl, F, $NO_3$, $SO_4$ |
| Ge-68 | Ga-69 | (p, 2n) | $NO_3$, Cl |
| I-123 | Te-123 | (p, n) | F (gas), H (gas), $TeO_4$ |
| | Te-124 | (p, 2n) | |
| I-124 | Te-124 | (p, n) | F (gas), H (gas), $TeO_4$ |
| | Te-125 | (p, 2n) | |
| Tc-94, Tc-94m | Mo-94 | (p, n) | $MoO_4$ |
| Pd-103 | Rh-103 | (p, n) | Cl, $SO_4$ |
| Br-76 | Se-76 | (p, n) | O, F (gas), $SeO_4$ |
| Cu-64 | Ni-64 | (p, n) | Ac, Br, Cl, I, $NO_3$, $SO_4$ |
| Zr-89 | Y-89 | (p, n) | Ac, Br, Cl, $NO_3$, $MoO_4$ |
| Y-86 | Sr-86 | (p, n) | Br, $NO_3$, I, CN, Cl |
| | Sr-87 | (p, 2n) | |
| At-211 | Bi-209 | (α, 2n) | Br, $Al_2O_4$(in $NH_4OH$) |
| V-48 | Ti-48 | (p, n) | Br, I, Cl (in alc) |
| Pb-203 | Tl-203 | (p, n) | $NO_3$, Cl, F, O, $SeO_4$, $SO_4$ |
| Re-186 | W-186 | (p, n) | $NO_3$, Cl, $SO_4$ |
| Sn-117m | Cd-116 | (α, 3n) | $NO_3$, Cl, $SO_4$ |

Thus, Table 1 provides a list of radioisotopes that can be produced with fluid PET-style target/chemistry modules in accordance with embodiments of the present invention. The target isotopes, in combination with the target material/carrier examples provided in Table 1, can be provided in the form of a compound or a complex. However, other compounds of the target isotopes that are soluble in water, aqueous solutions, and/or organic solvents, or that form a gas or vapor under suitable operating temperatures and pressures are also envisioned. Additionally, in certain instances the target isotope may be capable of existing in one or more oxidation states, and it is further contemplated that the compound and/or the complex can be used as a single oxidation species or as a mixture of more than one oxidation species.

According to an embodiment, the desired radioisotope is In-111. Accordingly, the target isotope is an isotope of cadmium and is at least one of Cd-110, Cd-111, or Cd-112, and the compound of the target isotope is a cadmium compound comprising chloride, fluoride, bromide, acetate, cyano, nitrate, sulfate, or selenate, or combinations thereof. For example, the cadmium compound, such as $CdCl_2$, can be dissolved in an appropriate fluid and used in the apparatus disclosed hereinafter.

According to another embodiment, the desired radioisotope is Pb-201. Accordingly, the target isotope comprises Tl-203, and the compound of the target isotope is a thallium compound comprising chloride, fluoride, nitrate, oxide, sulfate, or selenate, or combinations thereof. For example, the thallium compound, such as $TlCl_3$, can be dissolved in an appropriate fluid and used in the apparatus disclosed hereinafter.

According to another embodiment, where the desired radioisotope is Tl-201, a purified sample of Pb-201, which is prepared in accordance with an embodiment of the present invention and is substantially free of the target isotope Tl-203, can be permitted to decay to Tl-201 and a second separation step may be performed to isolate the decay product Tl-201 from the Pb-201 sample.

According to another embodiment, the desired radioisotope is Ga-67. Accordingly, the target isotope comprises Zn-68, and the compound of the target isotope is a zinc compound comprising chloride, fluoride, bromide, nitrate, sulfate, or acetate, or combinations thereof. For example, the zinc compound, such as $ZnCl_2$, can be dissolved in an appropriate fluid and used in the apparatus disclosed hereinafter.

According to another embodiment, the desired radioisotope is Ge-68. Accordingly, the target isotope comprises Ga-69, and the compound of the target isotope is a gallium compound comprising chloride or nitrate, or combinations thereof. For example, the gallium compound, such as $GaCl_3$, can be dissolved in an appropriate fluid and used in the apparatus disclosed hereinafter.

According to another embodiment, where the desired radioisotope is Ga-68, a purified sample of Ge-68, which is prepared in accordance with an embodiment of the present invention and is substantially free of the target isotope Ga-69, can be permitted to decay to Ga-68 and a second separation step may be performed to isolate the decay product Ga-68 from the Ge-68 sample.

According to another embodiment, the desired radioisotope is I-123 and/or I-124. Accordingly, the target isotope comprises at least one of Te-123, Te-124, or Te-125, and the compound of the target isotope is a tellurium compound comprising oxide, fluoride or hydride. For example, the tellurium compound, such as $Na_2TeO_4$, can be dissolved in an appropriate fluid and used in the apparatus disclosed hereinafter.

According to another embodiment, the desired radioisotope is Tc-94 and/or Tc-94m. Accordingly, the target isotope comprises Mo-94, and the compound of the target isotope is a molybdenum compound comprising a carboxylate such as acetate, oxide or a molybdate of ammonium, sodium or potassium. For example, the molybdenum compound, such as $Mo(OAc)_2$ or $Na_2MoO_4$, can be dissolved in an appropriate fluid and used in the apparatus disclosed hereinafter.

According to another embodiment, the desired radioisotope is Pd-103. Accordingly, the target isotope comprises Rh-103, and the compound of the target isotope is a rhodium compound comprising chloride or sulfate or combinations thereof. For example, the rhodium compound, such as $Rh_2(SO_4)_3$, can be dissolved in an appropriate fluid and used in the apparatus disclosed hereinafter.

According to another embodiment, the desired radioisotope is Br-76. Accordingly, the target isotope comprises Se-76, and the compound of the target isotope is a selenium compound comprising oxide, fluoride or a selenate or combinations thereof. For example, the selenium compound, such as $SeO_2$ or $Na_2SeO_4$, can be dissolved in an appropriate fluid and used in the apparatus disclosed hereinafter.

According to another embodiment, the desired radioisotope is Cu-64. Accordingly, the target isotope comprises Ni-64, and the compound of the target isotope is a nickel compound comprising acetate, bromide, chloride, iodide, nitrate, sulfate, or combinations thereof. For example, the nickel compound, such as $Ni(NO_3)_2$, can be dissolved in an appropriate fluid and used in the apparatus disclosed hereinafter.

According to another embodiment, the desired radioisotope is Zr-89. Accordingly, the target isotope comprises Y-89, and the compound of the target isotope is a yttrium compound comprising acetate, bromide, chloride, nitrate, or molybdate, or combinations thereof. For example, the yttrium compound, such as $Y(NO_3)_3$, can be dissolved in an appropriate fluid and used in the apparatus disclosed hereinafter.

According to another embodiment, the desired radioisotope is Y-86. Accordingly, the target isotope comprises Sr-86 and/or Sr-87, and the compound of the target isotope is a strontium compound comprising bromide, chloride, iodide, cyano, or nitrate, or combinations thereof. For example, the strontium compound, such as $Sr(NO_3)_2$, can be dissolved in an appropriate fluid and used in the apparatus disclosed hereinafter.

According to another embodiment, the desired radioisotope is At-211. Accordingly, the target isotope comprises Bi-209, and compound of the target isotope is a bismuth compound comprising bromide, or aluminate, or combinations thereof. For example, the bismuth compound, such as $BiBr_3$, can be dissolved in an appropriate fluid and used in the apparatus disclosed hereinafter.

According to another embodiment, the desired radioisotope is V-48. Accordingly, the target isotope comprises Ti-48, and the compound of the target isotope is a titanium compound comprising bromide, chloride, or iodide, or combinations thereof. For example, the titanium compound, such as $TiCl_4$, can be dissolved in an appropriate fluid and used in the apparatus disclosed hereinafter.

According to another embodiment, the desired radioisotope is Pb-203. Accordingly, the target isotope comprises Tl-203, and the compound of the target isotope is a thallium compound comprising chloride, fluoride, oxide, nitrate, sulfate, or selenate, or combinations thereof. For example, the thallium compound, such as $TlCl_3$, can be dissolved in an appropriate fluid and used in the apparatus disclosed hereinafter.

According to another embodiment, the desired radioisotope is Re-186. Accordingly, the target isotope comprises W-186, and the compound of the target isotope is a tungsten compound comprising nitrate, chloride, or sulfate, or combinations thereof. For example, the tungsten compound, such as $WCl_6$, can be dissolved in an appropriate fluid and used in the apparatus disclosed hereinafter.

According to another embodiment, the desired radioisotope is Sn-117m. Accordingly, the target isotope comprises Cd-116, and the compound of the target isotope is a cadmium compound comprising nitrate, chloride, or sulfate, or combinations thereof. For example, the cadmium compound, such as $Cd(NO_3)_2$, can be dissolved in an appropriate fluid and used in the apparatus disclosed hereinafter.

According to yet another embodiment, the fluid target matrix comprises a first target isotope and a second target isotope, where the first and second (i.e., a plurality) target isotopes is derived from the compounds recited above, to provide a first radioisotope and a second radioisotope upon irradiation with a suitable charged particle beam.

Referring now to FIG. 1, a target assembly 10 includes a target body 12 having a beam side 12*a* and a back side 12*b*. Situated on the beam side 12*a* is a window flange 14 secured to the beam side 12*a* of target body 12, and situated on the back side 12*b* is a back flange 16 secured to the back side 12*b* of target body 12. As appreciated by persons skilled in the art, the various flange sections of target assembly 10 can be secured to each other by any suitable means, such as by using appropriate fastening members such as threaded bolts. The target body 12 further includes an internal surface 13.

The window flange 14 includes a beam window aperture 14*a* to accommodate a beam window 18 that separates a charged particle source 20 from the target body 12 but permits the transmission of a particle beam 22 therethrough. Optionally, a beam window cooling system, which is usually in the form of a double window containing a coolant stream, (not shown), may be incorporated into the window flange 14 to provide convectional and/or conductional cooling to the beam window 18. Similarly, the back flange 16 may also include a cooling system 24 having an inlet 26 and outlet 28 for the flowing of a coolant medium therethrough and thereby provide direct cooling to the back flange 16 and/or indirect cooling to the target body 12 and a fluid target matrix 30 contained therein. The inlet 26 and outlet 28 may be configured to be detachably connected to a corresponding coolant supply source (not shown) such that after the irradiation with the particle beam 22, the target assembly 10 may be manually or automatically detached from a target holder and delivered to a processing location (not shown). However, generally the target assembly 10 further includes lines/ports (not shown) to transport fluids to and/or from the target body 12.

According to embodiments of the invention, the fluid target matrix 30 includes one or more compounds of a target isotope. In an embodiment, the one or more compounds are soluble in a liquid component of the fluid target matrix 30. According to one exemplary embodiment, the fluid target matrix 30 includes a liquid such as water, an aqueous solution, or an organic solvent. Accordingly, a source of the target isotope may include one or more compounds of the target isotope that are soluble in water, aqueous solutions, and/or organic solvents. Advantageously, the liquid target matrix embodiments are generally adaptable to existing PET F-18/FDG systems with little or no significant modifications to the target assembly 10.

According to an embodiment, the compound or complex of the target isotope is present in the liquid target matrix in a weight percent based on the entire weight of the fluid target matrix of at least 0.1% up to its saturation or supersaturation point in the liquid component making up the fluid target matrix. For example, the weight percent of the compound or the complex of the target isotope in the fluid target matrix can be within the range of about 1 wt % to about 100 wt %, about 2 wt % to about 50 wt %, about 2.5 wt % to about 30 wt %, about 5 wt % to about 25 wt %, or about 7 wt % to about 15 wt %, inclusive of the endpoints and various combinations thereof.

According to one example, a liquid component of the liquid target matrix includes water, which may be natural water ($H_2{}^{16}O$) or isotopically-enriched O-18 water, i.e., $H_2{}^{18}O$. Accordingly, the target isotope source includes water-soluble compounds and/or complexes that can be formed in aqueous solutions.

The pH of the aqueous target matrix can be varied to enhance the compatibility of the aqueous target matrix and the materials used in constructing the target assembly 10 that contact the aqueous target matrix. According to embodiments of the invention, the pH may be within a range from about 2 to about 12, from about 4 to 10, from about 5 to 9, or from about 6 to about 8. In one example, the pH is within a range from about 6.5 to about 7.

According to another example, a liquid component of the liquid target matrix includes an organic solvent. Accordingly, the target isotope source can include organic solvent-soluble compounds and/or complexes that can be formed in organic solvents. Suitable organic solvents include, but are not limited to, alcohols such as methanol, ethanol, or propanol; esters such as ethyl acetate or butyl acetate; chlorinated hydrocarbons such as chloroform or methylene chloride; or amides such as dimethylformamide or N-methylpyrrolidinone, for example.

According to another embodiment, the fluid target matrix is a gaseous target matrix that comprises a gas and optionally one or more carrier or target gases. Accordingly, the target isotope is derived from a gaseous compound. As such, a source of the target isotope may include one or more compounds that are capable of being volatilized under appropriate conditions and then flowed into and/or through the target body 12. Exemplary gaseous targets include, but are not limited to, $H_2Se$, $TeF_6$ at room temperature, or $TiCl_4$, $Se_2Cl_2$, or $Ni(CO)_4$ at moderately elevated temperatures (e.g., about 40° C. to about 120° C.), for example. Optionally, one or more carrier cases may be used to facilitate the transfer of the gaseous target isotope compound to the target body 12 and/or remove the irradiated gaseous target matrix from the target body 12. Exemplary carrier gases include, but are not limited to, nitrogen, hydrogen, argon, or air, for example. Advantageously, the gaseous target matrix embodiments are generally adaptable to existing PET targets used for generating C-11 from N-14 without substantial modifications to the C-11 PET target assembly 10.

In some instances, the product radioisotope may separate from the gaseous target matrix during the irradiation process and at least partially deposit on the internal surface of the target body. Accordingly, one suitable method of separating the product radioisotope may include pumping out any residual target isotope compound and washing the internal surface of the target body with a suitable fluid to remove the deposited target radioisotope. Optionally, the product radioisotope may then be subsequently separated from undesired by-products or target isotope compound with an automated chemistry system described below.

Other atomic and isotopic species may also be included in the liquid target matrix or the gaseous target matrix to enable the concurrent formation of other radioisotopes, such as F-18, N-13, and/or C-11. For example, where the particle beam 22 is a proton beam, fluorine-18 can be produced by proton bombardment of oxygen-18 through the $^{18}O(p,n)^{18}F$ nuclear reaction. Accordingly, to enable the concurrent production of F-18 and target radioisotopes, isotopically enriched oxygen (O-18) may be included in the fluid target matrix 30 in the form of $H_2{}^{18}O$, $^{18}O_2$, $N^{18}O_3^-$, $^{18}O_4^{-2}$, $Se^{18}O_4^{-2}$, and/or $Al_2{}^{18}O_4^{-2}$, for example.

Additionally, nitrogen-13 can be produced by proton bombardment of natural oxygen, which is greater than 99.7% oxygen-16, through the $^{16}O(p,\alpha)^{13}N$ nuclear reaction. Accordingly, to enable the concurrent production of N-13 and target isotopes, $H_2{}^{16}O$, $^{16}O_2$, $N^{16}O_3^-$, $S^{16}O_4^{-2}$, $Se^{16}O_4^{-2}$, and/or $Al_2{}^{16}O_4^{-2}$, may be included in the fluid target matrix 30 to produce $^{13}NH_3$. The use of a scavenger for oxidizing radicals has been successfully used to minimize in-target oxidation. One exemplary scavenger is ethanol.

Furthermore, carbon-11 can be produced by proton bombardment of natural nitrogen, which is greater than 99.6% nitrogen-14, through the $^{14}N(p,\alpha)^{11}C$ nuclear reaction. Accordingly, to enable the concurrent production of C-11 and other radionuclides, a nitrogen source, such as $^{14}NH_3$, $^{14}NH_4^{+1}$, $^{14}N_2$, $^{14}N^{16}O_3^{-1}$, or $^{14}N^{18}O_3^{-1}$, may be included in the fluid target matrix 30. For example, ammonium complexes conveniently provide N-14 in the target material. Alternatively, a target gas mixture of 2% oxygen in nitrogen or 5% hydrogen in nitrogen may be combined with a volatile target isotope compound in the fluid target matrix 30 to produce carbon dioxide ($^{11}CO_2$) or methane ($^{11}CH_4$), respectively, along with the desired radioisotope. Carbon monoxide ($^{11}CO$) can also be made by reduction of $^{11}CO_2$ on activated charcoal at 900° C.

The target body 12 and the internal surface 13 can be constructed from any material that is compatible with the fluid target matrix 30. Exemplary and non-limiting examples of suitable materials use in constructing the target body 12 and/or the internal surface 13 include stainless steel (e.g., SS 316), tantalum, HAVAR™, and polyether ether ketone (PEEK). Compatibility of the materials used in the target body 12 and/or the internal surface 13 can be evaluated by heating the proposed material to anticipated irradiation temperatures in the presence of the fluid target matrix 30.

The target body 12 of the target assembly 10 is not restricted to any particular shape or configuration. As shown in FIG. 1, the target body 12 may have a generally L-shaped cross-section that defines or has formed in its structure a target chamber 32 that is in fluid communication with an upper chamber 34. The upper chamber 34 is usually adapted to include ports (not shown), which accommodate introducing the fluid target matrix 30 into the target body 12 and/or removing the irradiated fluid target matrix after the irradiation of the fluid target matrix 30 with the particle beam 22. The target chamber 32 is represented by the lower leg of this L-shaped target body 12 and terminates at a beam strike section 36 of the beam side 12*a* for receiving the particle beam 22.

Additional optional features of the target body 12 may include a pressure transducer and/or a thermocouple, which are in fluid communication with the target chamber 32 and/or the upper chamber 34, and which also are in electrical communication with external instrumentation to provide pressure and temperature information relating to the inside of the target body 12.

In the liquid target matrix embodiment shown in FIG. 1, a portion of the upper chamber 34 may include a gaseous region 38, which thereby provides a liquid-gas interface 40 within the upper chamber 34. The liquid-gas interface 40 can facilitate modulating pressure changes arising from thermal expansion and contraction of the liquid target matrix during and after the irradiation step. In a gaseous target matrix embodiment, the one or more carrier or target gases flow through the target chamber 32. In some embodiments, the product radioisotope may separate from the gaseous target matrix and deposit on the internal surface 13 of the target body 12.

As further shown in FIG. 1, the beam window 18 is interposed between target body 12 and window flange 14 and defines beam strike section 36 of target chamber 32. Beam window 18 can be constructed from any material suitable for transmitting the particle beam 22 while minimizing loss of beam energy. A non-limiting example is a metal alloy such as the commercially available HAVAR™ alloy, although other metals such as titanium, tantalum, tungsten, stainless steel (e.g., SS 316), gold, and alloys thereof could be employed. Another purpose of beam window 18 is to demarcate and maintain the pressurized environment within target chamber 32 and the vacuum environment through which particle beam 22 is introduced to target chamber 32 at beam strike section 36. The thickness of beam window 18 can be sufficiently small so as not to degrade beam energy, and thus can range, for example, between approximately 0.3 and 50 μm. In one exemplary embodiment, the thickness of beam window 18 is approximately 25 μm. Compatibility of the materials used in the beam window 18 can be evaluated by heating the proposed material to anticipated irradiation temperatures in the presence of the fluid target matrix 30.

The window flange 14 in one non-limiting example is constructed from aluminum. Other suitable non-limiting examples of materials for window flange 14 include gold, copper, titanium, and tantalum. Window flange 14 defines the beam window aperture 14*a* generally aligned with beam window 18 and beam strike section 36 of target chamber 32.

Optionally, a window grid, which is not shown, can be mounted within beam window aperture 14*a* and abut beam window 18. The window grid may be useful in embodiments where the beam window 18 has a small thickness and therefore is subject to possible buckling or rupture in response to fluid pressure developed within target chamber 32. The window grid can have any design suitable for adding structural strength to the beam window 18, and thus prevent structural failure of beam window 18, while not appreciably interfering with the transmission of the particle beam 22. Accordingly, a window grid can comprise a plurality of hexagonal or honeycomb-shaped tubes having a depth of along the axial direction of beam travel ranging from about 1 to about 4 mm, and the width between the walls of each hexagonal or honeycomb-shaped tube can range from about 1 to about 4 mm. Where additional strength is not needed for the beam window 18, the window grid can be omitted.

Optionally, a double window (not shown) containing a coolant such as helium gas is may be used, which not only reduces the likelihood of rupturing the beam window 18 but also may remove heat from the beam window 18, the target body 12 and the fluid target matrix 30.

Back flange 16 may also be constructed from aluminum or other suitable materials such as copper and stainless steel. Similar materials may also be used to construct the cooling system 24.

As further shown in FIG. 1, target assembly 10 includes cooling system 24 having an inlet 26 and an outlet 28 for flow-through of a coolant medium and thereby provide direct cooling to the back flange 16 and/or indirect cooling to the target body 12 and the fluid target matrix 30 contained therein. A primary purpose of the cooling system 24 is to enable the heat energy transferred into target chamber 30 via particle beam 22 to be carried away from target assembly 10 via the circulating coolant. In the illustrated embodiment, the cooling system 24 comprises inlet 26 and outlet 28 to provide a passageway for the circulating coolant. In addition, the cooling system 24 fluidly may communicate with external components including, for example, a motor-powered pump, heat exchanger, condenser, evaporator, and the like.

It should be appreciated by those skilled in the art that the specific form, shape, or dimensions of the various components of the target assembly 10 may be modified and/or adapted to work in combination with each type and model of target holder presently in existence or those to be developed in the future.

The charged particle source 20 for the particle beam 22 may be of any suitable design. The particular type of particle source 20 employed in conjunction with the embodiments disclosed herein will depend on a number of factors, such as the beam power contemplated and the type of radioisotope to be produced. According to specific embodiments of the invention, the charged particle beam can be a proton beam having an average energy of at least about 5 MeV, a deuteron beam having an average energy of at least about 3 MeV, or an alpha beam having an average energy of at least about 5 MeV. Accordingly, average proton beam energies ranging from about 5 MeV to about 40 MeV, about 11 MeV to about 30 MeV, about 13 MeV to about 30 MeV, about 16 MeV to about 30 MeV, about 18 MeV to about 30 MeV, or about 24 MeV to about 30 MeV may be used; average deuteron beam energies ranging from about 3 MeV to about 15 MeV, from about 7 MeV to about 15 MeV, or from about 10 MeV to about 15 MeV may be used; or average alpha beam energies of about 5 MeV to about 50 MeV, from about 5 MeV to about 30 MeV, from about 10 MeV to about 30 MeV, from about 15 MeV to about 30 MeV, from about 20 MeV to about 30 MeV, or from about 20 MeV to about 50 MeV may be used.

Generally, for a beam power ranging up to approximately 1.5 kW (for example, a 100 μA current of protons driven at an energy of 15 MeV), a cyclotron or linear accelerator (LINAC) is typically used for the proton beam source. For a beam power typically ranging from approximately 1.5 kW to 15.0 kW (for example, 0.1-1.0 mA of 15 MeV protons), a cyclotron or LINAC adapted for higher power is typically used for the proton beam source. Similar beam powers are applicable to deuteron and alpha particles.

Similar to common F-18/FDG systems, the process of generating the desired radioisotope may be automated to control the time of bombardment, the energy of the protons and the current of the protons. These and other operating parameters may be determined based on a composition of the fluid target matrix, which is data that may be entered into a general controller.

Figure 2:
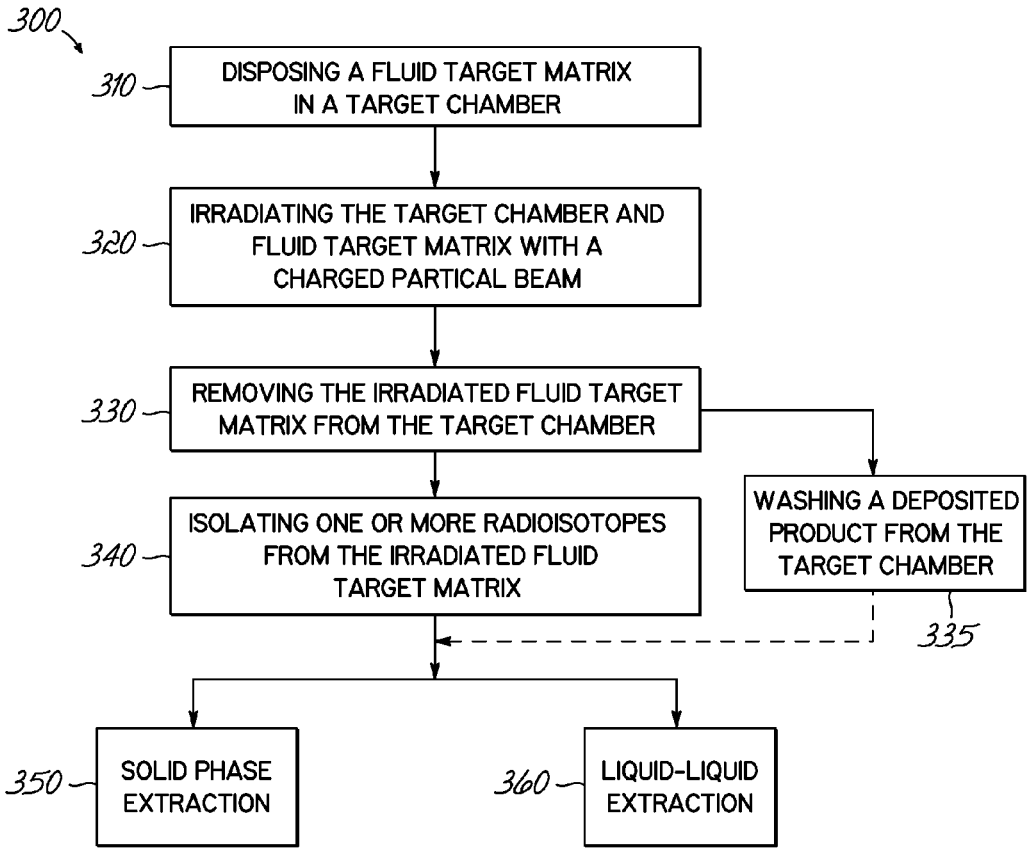

Referring now to FIG. 2, a flow chart 300 illustrating an exemplary embodiment of a method for producing one or more radioisotopes is discussed next. The method includes a step 310 of disposing a fluid target matrix in a target chamber. The fluid target matrix includes one or more compounds of a target isotope and optionally O-18, O-16, or N-14. The next step 320 involves irradiating the target chamber and fluid target matrix with a charged particle beam to transform at least a portion of the target isotope to the desired one or more radioisotopes, and optionally transform at least a portion of O-18 to F-18, at least a portion of the O-16 to N-13, or at least a portion of N-14 to C11. The irradiation of the fluid target matrix with the beam of charged particles may last for a time interval sufficient to produce a desired amount of the object radioisotope. For example, the irradiation duration may range between half an hour and 8 hours.

In step 330, at least a portion of the irradiated fluid target matrix is removed from the target body 12 to facilitate isolating the one or more radioisotopes. In step 335, when at least a portion of the product radioisotope deposits onto the internal surface 13 of the target body 12 during step 320, such as what occurs during some gaseous target matrix embodiments, the internal surface 13 may be contacted with a suitable fluid to wash out a deposited product radioisotope. For example, the product radioisotope may be washed off the internal surface 13 using water, an aqueous solution, or an organic solvent, or combinations thereof. Optionally, the wash residue containing the product radioisotope may be undergo additional chemical processing, such as solid phase extraction 350, liquid-liquid extraction 360, or combinations thereof to further purify the product radioisotope.

In step 340, the radioisotopes are isolated from the irradiated fluid target matrix. Several complementary procedures may be used alone or in combination to achieve the desired purification. For example and as discussed further below, the irradiated fluid target matrix may be removed from the target body 12 and transferred to a chemical processing station, which may include an automated chemistry unit. Chemical processing, such as solid phase extraction 350, liquid-liquid extraction 360, or combinations thereof may be used to recover a portion of the target isotope that has not undergone transformation to the radioisotope and purify the radioisotope. Exemplary substrates suitable for solid phase extraction include, but are not limited to, alumina, silica, ion exchange resins, or combinations thereof. Liquid-liquid extractions may be performed using two immiscible solvents, such as an organic solvent (e.g., methyl ethyl ketone), and aqueous solutions, which may be intermixed in any suitable manner to partition the irradiated target matrix between the phases.

The embodiments of the invention are illustrated by the following examples that are not to be regarded as limiting the scope of the invention or the manner in which it can be practiced.

Separation of Radioisotopes from Simulated Target Matrix Solutions:

The separation methods described herein are specifically applicable to liquid target matrix irradiations, although the methods are also applicable to solid target irradiations, after the target/product matrix has been dissolved in a suitable liquid. Additionally, the solutions described below are all aqueous, although the process can be envisioned for organic solvents, as well, as long as the target isotope and product radioisotopes can form complexes of the same form (e.g., bromides, acetates, carbonyls) that are soluble in the same organic solvent.

The basic process is as follows. The fluid target matrix is an aqueous solution of the compound or complex comprising the target isotope (ideally, near the saturation point of the compound or complex of the target isotope in the aqueous solution, in order to maximize the effective density of the target isotope) is irradiated with the appropriate particle beam to produce a product radioisotope. The irradiated fluid target matrix is then passed through a scrubbing resin using a first eluent, where the scrubbing resin retains the product radioisotope but allows the remaining target isotope to pass through. Washing of the scrubbing resin with the first eluent removes the target isotope while leaving the product radioisotope on the scrubbing resin. Then, the product radioisotope is removed from the scrubbing resin in a minimum amount of a second eluent. A final polishing treatment may optionally be performed to purify the product radioisotope in order to obtain the radioisotope in a useful form. It should be apparent to the skilled artisan that this method is only viable where the target isotope and product radioisotope are not isotopes of the same element.

Examples are given below. Solution volumes are based on the use of Bruce Technologies targets, holding 2.5-3 mL of solution. Although embodiments of the present invention will involve the generation of the radioisotopes in situ from a fluid target matrix, laboratory experiments were performed using simulated fluid target matrices prepared by spiking liquid target matrices of compounds having a target isotope (or its chemical equivalent) with solutions of the product radioisotope (or its chemical equivalent). Alternatively, separations may be performed using a sample derived from an irradiated solid target method.

Technetium Separation from Molybdenum:

The resin used for this separation is SuperLig™ 639, provided by IBC Advanced Technologies (henceforth, "IBC"). This resin was developed for the removal of pertechnetate-99 (not -99m) waste from brine solutions. It binds pertechnetate as an ion pair (e.g., $NaTcO_4$, $KTcO_4$, $NH_4TcO_4$, or even $HTcO_4$,) as long as the overall ionic strength of the solution is high. The pertechnetate salt can be removed by lowering the ionic strength, for example, by eluting with water; raising the temperature improves the pertechnetate removal. Solutions of sodium molybdate ($Na_2MoO_4$, SM); potassium molybdate ($K_2MoO_4$, PM); and ammonium molybdate ($(NH_4)_2MoO_4$, AM) are soluble in water to different degrees. PM, the least soluble, can be generated at approximately 15% Mo content at ambient temperature, so all of the solutions were made with approximately 15% Mo content.

First, the scrubbing resin (approximately 0.25 g) was pre-treated with 3 mL of the SM solution. Next, 3 mL of the SM solution, spiked with 10-30 mCi of purchased sodium pertechnetate ($NaTcO_4$) solution, was passed slowly through the resin at ambient temperature. Residual SM solution was removed from the resin by passing 3 mL of 1.0 M NaOH through the resin. Then, the pH was adjusted to approximately 7, while maintaining a high ionic strength, by passing 3 mL of 0.5 M NaCl through the resin. Elution with 11 mL of deionized water at 75° C. followed, the first 1.5 mL of eluate being discarded as waste, and the remainder being passed through a short plug (0.2 g) of acidic alumina to trap the $NaTcO_4$ and any residual SM. The pertechnetate was removed with 1.5 mL normal saline. This procedure was performed multiple times and yields of about 90% of molybdate-free pertechnetate in normal saline were obtained. The NaOH eluate was passed through a strong-acid ion exchange resin to remove excess NaOH and to provide a dilute SM solution. This dilute SM solution was evaporated down to about 1 mL, and the resulting solution combined with the SM solutions recovered from the first two steps. Accordingly, molybdenum recoveries on the order of about 90% were also achieved.

Solutions of AM and PM can be treated the same way, with the NaOH elution replaced with ammonium or potassium hydroxide, respectively. Accordingly, the foregoing process is amenable to isolating Tc-94, and/or Tc-94m product radioisotopes from an irradiated fluid target matrix comprising a Mo-94 target isotope compound, for example. It should be further appreciated that the foregoing method to separate technetium from molybdenum is amenable for separating tungsten from rhenium (e.g., W-186 and Re-186)

Indium Separation from Cadmium:

The resin used for this separation was AnaLig™ In-01 Si, provided by IBC. Cadmium sulfate ($CdSO_4$, CS) solutions at a pH approximately equal to 1 and about 15% Cd were prepared by combining appropriate amounts of CdO, deionized water, and concentrated $H_2SO_4$. Sample solutions were prepared by spiking the CS solution with $InCl_3$.

The AnaLig™ In-01 Si scrubbing resin (0.5 g) was first pre-treated with 1 mL 0.05 M $H_2SO_4$. Then the sample solution (3 mL) was slowly passed through the scrubbing resin. Another 4 mL 0.05 M $H_2SO_4$ was then passed through, to remove excess CS. Deionized water (5 mL) was then passed through to remove sulfuric acid. Finally, the indium was removed as a chloride complex by eluting with 3 M HCl (4 mL) and passing the eluate through a short plug of AG1-X4 resin (Bio-Rad) to remove residual Cd. Cd-free $InCl_3$ was obtained in >80% yield. Higher yields may be expected with less AG1-X4. For example, virtually quantitative recovery of $InCl_3$ can be achieved if the AG1-X4 is completely omitted, but the indium product obtained is generally contaminated with about 1000-4000 ppm Cd. Accordingly, the foregoing process is amenable to isolating In-111 product radioisotope from an irradiated fluid target matrix comprising a cadmium-110, -111, and/or -112 target isotope compound, for example.

Copper Separation from Nickel:

Method A: For this example, testing was performed using cold Cu, because radioactive Cu (Cu-64 or Cu-67) was not readily available. A Cu/Ni mixture was prepared in 6 N HCl containing about 7.5% Ni by weight and about 1% Cu by weight, which is much higher Cu content than that expected in an irradiated fluid target matrix of a nickel compound, but provided an indication for the robustness of the Cu/Ni separation and resin column capacity.

A column was prepared by slurrying 1 g of AG1-X8 resin in 6 N HCl. A sample of the Cu/Ni solution was added to the column and eluted first with 6 N HCl (3 mL), to remove Ni, and then with deionized water (3 mL), to remove the Cu.

Method B: The test solution was a mixture of $Ni(NO_3)_2$ (~11.25% Ni) and $Cu(NO_3)_2$ (127 ppm) in 0.1 N $HNO_3$, and the scrubbing resin was AnaLig™ Cu-01 Si, provided by IBC, with the purpose being the scrubbing of Cu from the Ni solution, followed by the elution of Ni-free Cu.

After pre-treating the resin (0.5 g) with 0.1 N $HNO_3$, 3 mL of the sample solution was passed through. Excess Ni was removed by passing another 4 mL 0.1 N $HNO_3$. The Cu was then removed with 3 mL 5.0 N $HNO_3$. Greater than 97% recovery of Ni was achieved, but only about 80% of the Cu was recovered in the strong acid as a portion of the Cu was in the Ni fraction. The Cu fraction was contaminated with about a mass equivalent of Ni. Accordingly, the foregoing processes (A and B) are amenable to isolating Cu-64 product radioisotope from an irradiated fluid target matrix comprising a Ni-64 target isotope compound, for example.

Tin Separation from Cadmium:

An exemplary irradiated fluid target matrix of Sn-117 m/Cd-116 may be prepared from the bombardment of electroplated Cd-116 with alpha particles, as described in U.S. Patent Application Publication No. 2010/0166653, which is hereby incorporated by reference herein in its entirety. Alternatively, a sample solution was prepared by diluting 1 mL of a solution containing 0.13 g/mL Cd in 9 N HCl with 19 mL 0.1 M KCl and spiking the solution with 282 μCi of Sn-117m. Passing this solution through 0.4 g AnaLig™ Sn-01 PS resin (from IBC) was used to scrub Sn from the Cd solution.

After pretreating 0.4 g of the scrubbing resin with the 0.1 M KCl (2 mL), the Cd/Sn solution mixture was then passed through the resin. Deionized water (3 mL) was then eluted to remove excess Cd. Sn was removed by eluting with 14 mL 0.3 M HCl. The yield of Sn-117m, substantially free from Cd, was 41%. Accordingly, the foregoing process is amenable to isolating Sn-117m product radioisotope from an irradiated fluid target matrix comprising a Cd-116 target isotope compound, for example.

As used herein and in the appended claims, the singular forms "a", "an", and "the" include plural reference unless the context clearly dictates otherwise. As well, the terms "a" (or "an"), "one or more" and "at least one" can be used interchangeably herein. It is also to be noted that the terms "comprising", "including", "characterized by" and "having" can be used interchangeably.

While the invention has been illustrated by the description of one or more embodiments thereof, and while the embodiments have been described in considerable detail, they are not intended to restrict or in any way limit the scope of the appended claims to such detail. For example, other target isotope and radioisotope pairs listed in Table 1 are envisioned to be separable by methods similar to those described herein with the use of appropriately selected commercial resins. Additional advantages and modifications will readily appear to those skilled in the art. The invention in its broader aspects is therefore not limited to the specific details, representative product and/or method and examples shown and described. The various features of exemplary embodiments described herein may be used in any combination. Accordingly, departures may be made from such details without departing from the scope of the general inventive concept.

What is claimed is:

1. A method of producing a radioisotope, the method comprising:

irradiating a fluid target matrix in a target body, said fluid target matrix comprising a compound of a target isotope dissolved in a fluid with a charged particle beam to transform at least a portion of the target isotope to the radioisotope and provide an irradiated fluid target matrix; and isolating the radioisotope from the irradiated fluid target matrix, wherein the target isotope is selected from the group consisting of: an isotope of cadmium, an isotope of thallium, an isotope of zinc, an isotope of gallium, an isotope of tellurium, an isotope of molybdenum, an isotope of rhodium, an isotope of selenium, an isotope of nickel, an isotope of yttrium, an isotope of strontium, an isotope of bismuth, an isotope of tungsten, and an isotope of titanium, with the proviso that the isotope of molybdenum is not Mo-100.

2. The method of claim 1, wherein the radioisotope is In-111, wherein the target isotope is an isotope of cadmium and is at least one of Cd-110, Cd-111, or Cd-112, and wherein the compound is a cadmium compound comprising chloride, fluoride, bromide, acetate, cyano, nitrate, sulfate, or selenate, or combinations thereof.

3. The method of claim 1, wherein the radioisotope is Pb-201, wherein the target isotope comprises Tl-203, and wherein the compound is a thallium compound comprising chloride, fluoride, nitrate, oxide, sulfate, or selenate, or combinations thereof.

4. The method of claim 1, wherein the radioisotope is Ga-67, wherein the target isotope comprises Zn-68, and wherein the compound is a zinc compound comprising chloride, fluoride, bromide, nitrate, sulfate, or acetate, or combinations thereof.

5. The method of claim 1, wherein the radioisotope is Ge-68, wherein the target isotope comprises Ga-69, and wherein the compound is a gallium compound comprising chloride or nitrate, or combinations thereof.

6. The method of claim 1, wherein the radioisotope is Tc-94 and/or Tc-94m, wherein the target isotope comprises Mo-94, and wherein the compound is a molybdenum compound comprising a carboxylate, oxide, a molybdate of ammonium, sodium, or potassium, or combinations thereof.

7. The method of claim 1, wherein the radioisotope is Pd-103, wherein the target isotope comprises Rh-103, and wherein the compound is a rhodium compound comprising chloride, or sulfate, or combinations thereof.

8. The method of claim 1, wherein the radioisotope is Cu-64, wherein the target isotope comprises Ni-64, and wherein the compound is a nickel compound comprising acetate, bromide, chloride, iodide, nitrate, or sulfate, or combinations thereof.

9. The method of claim 1, wherein the radioisotope is Zr-89, wherein the target isotope comprises Y-89, and wherein the compound is a yttrium compound comprising acetate, bromide, chloride, nitrate, or molybdate, or combinations thereof.

10. The method of claim 1, wherein the radioisotope is At-211, wherein the target isotope comprises Bi-209, and wherein the compound is a bismuth compound comprising bromide, or aluminate, or combinations thereof.

11. The method of claim 1, wherein the radioisotope is V-48, wherein the target isotope comprises Ti-48, and wherein the compound is a titanium compound comprising bromide, chloride, or iodide, or combinations thereof.

12. The method of claim 1, wherein the radioisotope is Pb-203, wherein the target isotope comprises Tl-203, and wherein the compound is a thallium compound comprising chloride, fluoride, oxide, nitrate, sulfate, or selenate, or combinations thereof.

13. The method of claim 1, wherein the radioisotope is Re-186, wherein the target isotope comprises W-186, and wherein the compound is a tungsten compound comprising nitrate, chloride, sulfate, or combinations thereof.

14. The method of claim 1, wherein the radioisotope is Sn-117m, wherein the target isotope comprises Cd-116, and wherein the compound is a cadmium compound comprising nitrate, chloride, sulfate, or combinations thereof.

15. The method of claim 1, wherein the fluid target matrix comprises water.

16. The method of claim 15, wherein the water is $H_2{}^{18}O$, and at least a portion of the O-18 is transformed to F-18.

17. The method of claim 16, further comprising:

separating at least a portion of the F-18 from the irradiated fluid target matrix.

18. The method of claim 1 further comprising:

isolating a portion of the target isotope from the irradiated fluid target matrix to provide a recovered sample of the target isotope; and irradiating the recovered sample of the target isotope with the charged particle beam to transform at least a portion of the recovered sample of the target isotope to the radioisotope.

19. The method of claim 1, wherein the fluid target matrix comprises an organic liquid.

20. The method of claim 1 wherein the charged particle beam is a proton beam having an average energy of at least about 5 MeV, a deuteron beam having an average energy of at least about 3 MeV, or an alpha beam having an average energy of at least about 5 MeV.

21. The method of claim 1, wherein isolating the radioisotope from the irradiated fluid target matrix comprises:

transferring the irradiated fluid target matrix out of the target body;

optionally, contacting the internal surface of the target body with a fluid to remove a residual portion of the radioisotope from within the target body; and separating at least a portion of radioisotope from the target isotope.

* * * * *